US005201395A

United States Patent [19]

Takizawa et al.

[11] Patent Number: 5,201,395

[45] Date of Patent: Apr. 13, 1993

[54] BILL EXAMINATION DEVICE

[75] Inventors: Ienobu Takizawa; Takashi Yajima; Mitsunori Shigeta, all of Tokyo, Japan

[73] Assignee: Oki Electric Industry Co., Ltd., Tokyo, Japan

[21] Appl. No.: 759,159

[22] Filed: Sep. 13, 1991

[30] Foreign Application Priority Data

Sep. 27, 1990 [JP] Japan ..... 2-255327
Sep. 27, 1990 [JP] Japan ..... 2-255328

[51] Int. Cl.[5] ..... G07D 7/00

[52] U.S. Cl. ..... 194/206; 194/207; 209/534

[58] Field of Search ..... 194/205, 206, 207; 209/534; 382/7

[56] References Cited

U.S. PATENT DOCUMENTS

| | | | |
|---|---|---|---|
| 3,246,295 | 4/1966 | Claris et al. | 194/207 X |
| 3,480,785 | 11/1969 | Aufderheide | 194/207 X |
| 3,509,535 | 4/1970 | Berube | 209/534 X |
| 3,725,667 | 4/1973 | Schwartz | 209/534 X |
| 3,778,628 | 12/1973 | Novak et al. | 209/534 X |
| 4,058,194 | 11/1977 | Riddle et al. | 194/207 |
| 4,114,804 | 9/1978 | Jones et al. | 194/207 X |
| 4,349,111 | 9/1982 | Shah et al. | 194/206 X |
| 4,442,541 | 4/1984 | Finkel et al. | 2090/534 X |
| 4,464,786 | 8/1984 | Nishito et al. | 382/7 |
| 4,487,306 | 12/1984 | Nao et al. | 194/207 |
| 4,542,829 | 9/1985 | Emery et al. | 205/534 |
| 4,677,682 | 6/1987 | Miyagawa et al. | 194/207 X |
| 4,749,076 | 6/1988 | Akagawa et al. | 194/207 |
| 4,809,837 | 3/1989 | Hayashi | 194/207 X |

FOREIGN PATENT DOCUMENTS

| | | | |
|---|---|---|---|
| 196380 | 12/1982 | Japan | 194/207 |
| 108185 | 4/1990 | Japan | 194/207 |
| 109191 | 4/1990 | Japan | 194/207 |

*Primary Examiner*—Frank E. Werner
*Assistant Examiner*—Scott L. Lowe
*Attorney, Agent, or Firm*—Spencer, Frank & Schneider

[57] ABSTRACT

In a bill examination device in which a signal pattern obtained by scanning the bill with a photo-detector or a magnetic detector is compared with a reference for testing the authenticity, the signal is subjected to differentiation or removal of a direct-current component before the comparison. The effect of the differences or offsets of the detector or its associated circuit due to manufacturing variations, temperature change, or aging, and differences in the darkness of printing or smudge on the bill is reduced, and the reliability of the authenticity test is improved.

27 Claims, 8 Drawing Sheets

BILL EXAMINATION DEVICE

FIELD OF THE INVENTION

The present invention relates to a bill examination device used in an automatic cash deposit/dispensation machine or an automatic vending machine, and testing the authenticity of the bill.

BACKGROUND OF THE INVENTION

When a bill (i.e., bank note or paper currency) is inserted or entered by a customer into an automatic cash deposit/dispensation machine or an automatic vending machine, the denomination of the bill is identified and the authenticity of the bill is tested. For this reason, a bill examination device is used.

The bill examination device detects a magnetic pattern or an optical pattern of reflected light or transmitted light of a bill that has been entered, compares it with a preset reference pattern, and, on the basis of the similarity with the reference pattern, tests the authenticity of the bills that has been entered into the machine.

A problem associated with the prior-art bill examination device described above is the similarity test is easily affected by differences or variations in the sensitivities or offsets of the detecting elements and other circuit components due to manufacturing inaccuracies, due to temperature change or due to aging (change with lapse of time), or differences in the darkness of printing of the bill or smudge on the bill, and if the required level of similarity is lowered to allow for the variations, a forged bill may erroneously be found as an authentic bill. Thus, the reliability of the authenticity test is degraded.

SUMMARY OF THE INVENTION

An object of the invention is to improve the reliability of the authenticity test.

A bill examination device according to a first aspect of the invention comprises:

a detecting means for detecting a physical pattern of a bill;

a differentiating means for differentiating the physical pattern to produce a differential pattern;

an allowable range pattern generating means for outputting an allowable range pattern;

a comparing means for comparing the differential pattern with the allowable range pattern, and outputting the result of comparison; and a judgement means responsive to the result of comparison from the comparing means for making judgement on the authenticity of the bill.

A bill examination device according a second aspect of the invention comprises:

a detecting means for detecting a physical pattern of a bill;

a reference pattern generating means for outputting a reference pattern;

a subtracting means for determining the difference between the physical pattern and said reference pattern to produce a difference pattern;

a filter means for removing the direct-current component from the difference pattern to produce a filtered difference pattern; and an evaluating means for evaluating the filtered difference pattern to test the authenticity of the bill.

DETAILED DESCRIPTION OF THE PREFERRED EMBODIMENTS

Figure 1:
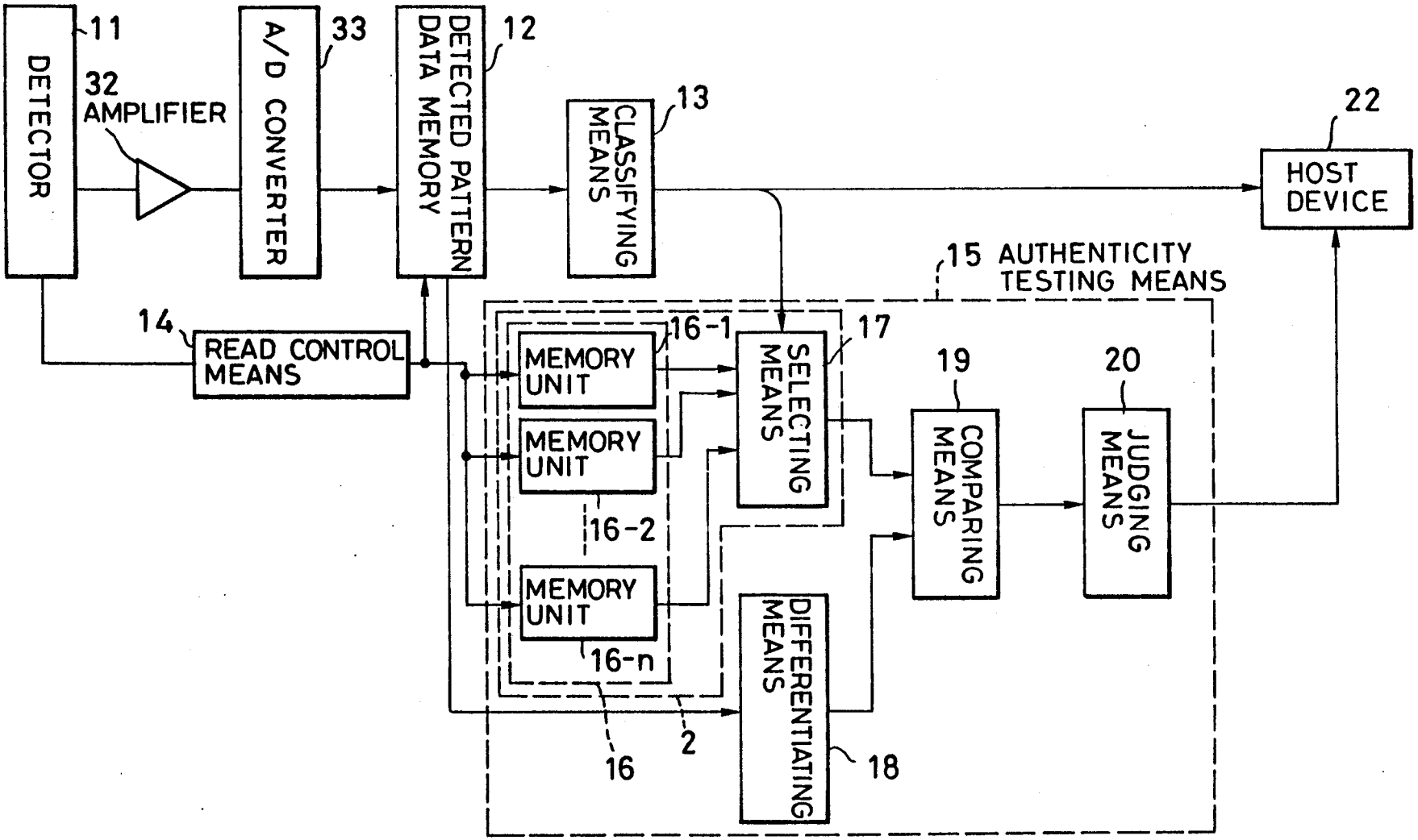
FIG. 1 is a block diagram showing a first embodiment of a bill examination device according to the invention.

A first embodiment of the invention will now be described with reference to FIG. 1 to FIG. 4.

The illustrated bill examination device can be incorporated in an automatic deposit/dispensation machine or an automatic vending machine, and used for examining the bill, particularly for identifying the denomination and testing the authenticity of the bill that has been entered into the machine.

The examination device comprises a detector 11 which is disposed by a bill conveyance path along which the bill that has been inserted or entered by the customer or user into the machine is conveyed or moved. The detector 11 may be brought into the operating state when the arrival of a bill that has been entered is notified by an output from a bill detector (not shown) or a signal from a host device 22.

The detector 11 comprises detecting elements disposed at different positions in the direction lateral with respect to the longitudinal direction of the bill conveyance path, i.e., the direction in which the bill is moved for conveyance, past the detecting elements. Each of the detecting elements may comprise a photo-coupler consisting of a light-emitting diode and a photo-detecting element, such as a photo-diode or a photo-transistor, or a magnetic detecting element such as a magnetic head. The photo-detecting element is responsive to light reflected from the surface of the bill or light transmitted through the bill. The intensity of the reflected light depends on the printed design or marks on the bill, and more specifically the darkness at each point of the bill. The intensity of the transmitted light also depends on the printed design and marks on the bill, as well as watermarks formed in the bill. The intensity of the reflected light depends on the printed design or marks on the bill, and more specifically the darkness at each point of the bill. The intensity of the transmitted light also depends on the printed design and marks on the bill, as well as watermarks formed in the bill. The intensity of an electric signal obtained by the magnetic head depends on the spatial density (density per area) of magnetic ink which contains a magnetic material and is used for the printing of the design or marks on the bill.

The plurality of detecting elements may be arranged in an array extending at a right angle with the direction in which the bill is moved for conveyance, or may alternatively be arranged in an array extending obliquely with respect to the direction in which the bill is moved. Such an arrangement may be convenient but is should be noted that the detecting elements need not be arranged in an array at all: what is essential is that the detecting elements are disposed at different positions in the lateral direction.

As the bill is moved along the conveyance path, relative to the detector 11, the bill is effectively scanned by the detecting element of the detector 11, and a series of electric signals indicative of the intensity of the light or the density of the magnetic ink along a line parallel to the direction of the movement of the bill is produced. The electric signals so obtained are called detection signals, the lines on the bill along which the bill is scanned by the detecting elements are called scan lines, and a series of detections signals obtained by scanning along each scan line is called a detected physical pattern for the respective scan line.

The plurality of detecting elements which are disposed at different lateral positions simultaneously produce a plurality of physical patterns formed of series of detection signals indicative of the light strength or the magnetic ink density along scan lines parallel to the direction of the movement of the bill. The plurality of the series of detection signals are output successively or being multiplexed.

An amplifier 32 having its input connected to the output of the detector 11 amplifies the detection signals from the detector 11 to a predetermined voltage level. An analog-to-digital (A/D) converter 33 having its input connected to the output of the amplifier 32 converts the analog detection signals from the amplifier 32 into digital signals, or detected pattern data.

A detected pattern data memory means 12 is connected to the output of the detector 11 and temporarily stores the detected pattern data.

The detected pattern data represents detected pattern p(t) in the form of a function of a distance t from a reference point on the bill, e.g., on a leading end of the bill, along the respective scan line.

Figure 2:
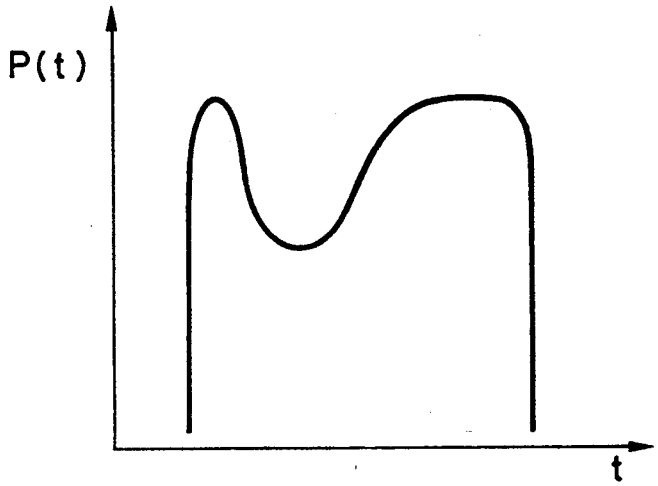
FIG. 2 to FIG. 4B are diagrams for explaining the operation of the bill examination device of FIG. 1.

An example of detected pattern, which in this example is a reflected light pattern detected by a detecting element is shown in FIG. 2.

A classifying means 13 having its input connected to the memory means 12 is responsive to the detected pattern data from the memory means 2, and identifies the class of the bill. Here the term "class" of the bill is determined not only by its denomination, but also the direction of the bill, i.e., which of the two ends is in front (while the bill passes the detecting element) and the side, i.e., which of the two sides, the obverse side or reverse side, is facing the detecting elements (while the bill passes the detecting elements).

The classifying means 13 compares the detected pattern data with class reference patterns for the respective classes and for the corresponding scan lines, and on the basis of the similarity between the detected pattern and the class reference patterns, identifies the class. Alternatively, presence of absence of a certain pattern, such as a watermark, unique to each class may be determined to identify the class.

The entirely or part only of the detected pattern data may be used for the comparison. Using part only of the detected pattern is efficient when the classification is made on the basis of presence of absence of a certain pattern unique to each class.

The class reference patterns may be pre-formed and stored in a reference pattern memory, not shown, provided separately, or built in the classifying means 13. The class reference patterns may be a pattern obtained when an ideal bill (clean authentic bill printed with an average or designed darkness) of the class in question is scanned.

As a result of the classification, the classifying means 13, produces the class data indicating the class of the bill, and sends the class data to an allowable range reference selecting means 17 and the host device 22.

A read control means 14 receives the output of the detector 11 and controls reading of the detected pattern data from the memory means 12 and supply of the detected pattern data to a differentiating means 18. The reading of the detected pattern data is initiated in response to the output of the detector 11, and after the writing of the detected pattern into the memory means 12 is completed.

The read control means 14 also supplies an allowable range pattern memory means 16 with scan line data indicating the scan line of the detected pattern data which is being read from the memory means 12 and supplied to the differentiating means 18.

The allowable range pattern memory means 16, the selecting means 17 and differentiating means 18 are a part of an authenticity testing means 15, which also comprises a comparing means 19 and a judging means 20.

The authenticity testing means 15 receives the detected pattern data from the memory means 12, the class data from the classifying means 13, and the scan line data from the read control means 14, and tests the authenticity of the bill, to produce the authenticity data indicating whether the bill is authentic or forged, and sends the authenticity data to the host device 22.

The allowable range reference memory means comprises memory units 16-1 to **16-*n* which store allowable range reference data indicative of allowable range patterns for the respective classes and the respective scan lines. More specifically, the memory units 16-1 to 16-*n* are provided for the respective classes, and each of the memory units 16-1 to 16-*n*** stores the allowable range reference data for all the scan lines in the bill o the class for which it is provided.

The allowable range reference data for each scan line of each class comprises an upper-limit reference pattern $g_{max}(t)$ and a lower-limit reference pattern $g_{min}(t)$ in the form of a function of a distance from the reference point, e.g., a leading end, on the bill along the scan line, with the upper-limit reference pattern and the lower-limit reference pattern defining an allowable range within which the differential of the detected pattern is expected to lie if the bill is authentic.

By supplying the scan line data, as address information, to all the memory units 16-1 to **16-*n*, the read control means 14 addresses the allowable range reference data for the same scan lines of the different classes, so that the memory units 16-1 to 16-*n*** are ready to produce the allowable range reference data when accessed for reading.

It is convenient that the allowable range reference data of the scan lines scanned by identical detecting elements be stored in corresponding memory locations in the memory units 16-1 to **16-*n* which are addressed by identical address information from the read control means 14**.

On the basis of the class data, the allowable range reference selecting means 17 selects the memory unit **16-*i* (one of the memory nits 16-1 to 16-*n***) which stores the authentic reference data for the particular class. The allowable range reference data of the selected memory unit 16-*i* and of the scan line designated by the read control line 14 is output to the comparing means 19.

The differentiating means 18 has its input connected to the output of the memory means 12, and differentiates the detected pattern p(t) to produce data representing a differential pattern p'(t) in the form a function of the distance t. The differentiation is expressed by the following expression.

$$p'(t)=dp/dt$$

Where the detection signals are obtained for the points separated by equal distances on a scan line, the differentiation can be implemented by having the difference between successive detection signals, i.e., $$p'(t)=p_j=p_{j-1}$$

where $p_j$ represents a detection signal of a point in question, and $p_{j-1}$ represents a detection signal of a point immediately preceding the above-mentioned point in question.

Figure 3:
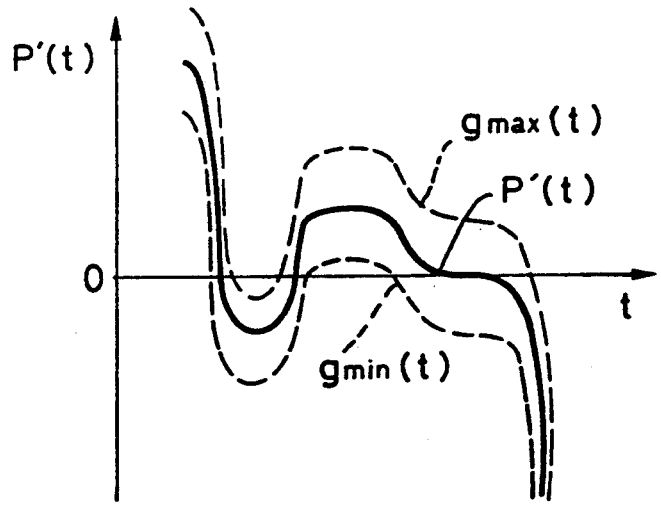

An example of differential pattern obtained by differentiating the detected pattern of FIG. 2 is shown in FIG. 3.

The comparing means 19 compares the differential pattern data p'(t) with the allowable range pattern to determine the similarity between the differential pattern and the allowable range pattern. Specifically, the comparing means 19 makes judgement as to whether the differential pattern is within allowable range between the upper-limit reference pattern $g_{max}(t)$ and the lower-limit reference pattern $g_{min}(t)$. The comparing means 19 produces a comparison result signal indicative of the result of comparison. The comparison result signal may be a one-bit binary signal which assumes "0" if the differential pattern is within the allowable range, and "1" if the differential signal not within the allowable range.

Figure 4A:
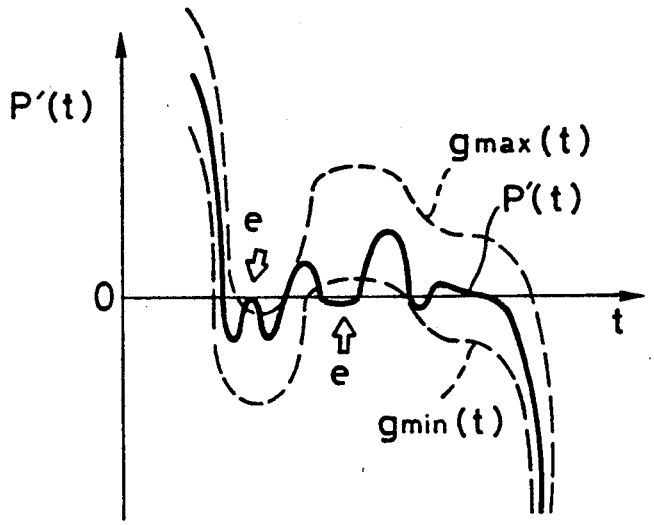
Figure 4B:
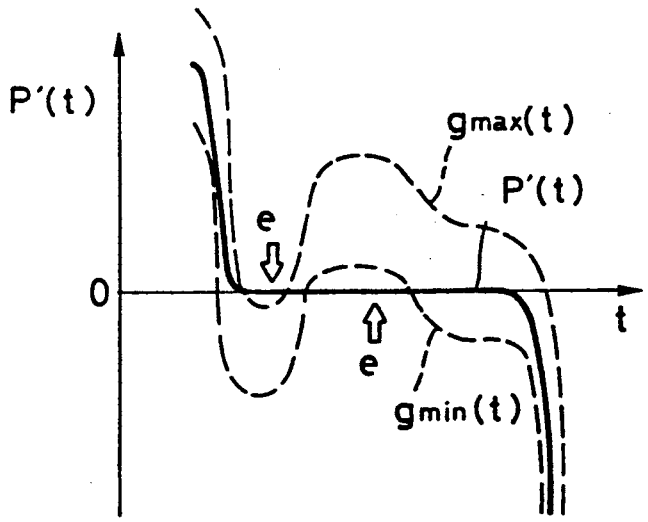

FIG. 4A shows an example of differential pattern p'(t) which falls outside the allowable ranges at e1 and e2. FIG. 4B shows another example of differential pattern p'(t) which falls outside the allowable ranges at e3 and 34. In either of these cases, the comparison result negates the authenticity.

The judging means 20 makes a final or synthetic judgement on whether the bill is authentic or forged, on the basis of the comparison result signals for a plurality of scan lines, e.g., all the scan lines on the bill, and outputs the authenticity test result signal to the host device 22. For instance, when the result of comparison negates the authenticity in connection with a predetermined number or more the scan lines, the result of the synthetic judgement may be recognition of the bill as a forged one. The above-mentioned predetermined number may be one. Naturally, if the bill is not recognized as a forged one, the bill is found as an authentic one. The synthetic judgement result is sent, as the authenticity test result, to the host device 22.

In the above embodiment, the allowable range pattern memory means 16 and the selecting means 17 in combination form an allowable range pattern generating means 2, which is responsive to the class data from the classifying means 13 and the scan line data from the read control means 14 and output an allowable range pattern data for the particular scan line of the particular class. The configuration of the allowable range pattern generating means 2 may be different from that illustrated. For instance, the selecting means 17 may be omitted, and the memory means 16 is so formed as to store the allowable range pattern data for the respective scan lines for the respective class at memory locations which are addressed by the address information generated by combining the class data and the scan line data.

As has been made clear from the above description, a plurality of detecting elements forming the detector 11 are disposed at different lateral positions, and the differential of the detected patterns are compared with the respective allowable range patterns, and, on the basis of the results of comparison, the authenticity is tested. The effect of the differences or variations in the sensitivities or offsets, or the differences in the darkness of the printing on the bill or smudge on the bill is therefore reduced, and the reliability of the authenticity test is improved.

The bill examination device of FIG. 1 can be configured of logic circuits, but can also be configured of a combination of a programmed microcomputer and logic circuits.

In the above embodiment, the differential of the detected patterns form a plurality of detecting elements are used for the authenticity test. But the authenticity may alternatively be tested on a differential of the detected pattern from a single detecting element.

A second embodiment of the invention will now be described with reference to FIG. 5 to FIG. 8.

Members identical to those in FIG. 1 are denoted by identical reference numerals and their description is omitted. A read control means 24 is similar to the read control means 14 of the embodiment of FIG. 1, but is connected a little differently and has somewhat different functions. Provided in place of the authenticity testing means 15 of the embodiment FIG. 1 is an authenticity testing means 25, which includes a reference pattern generating means 4, a subtractor 42, a filter 43, and an evaluating means 5.

Figure 6:
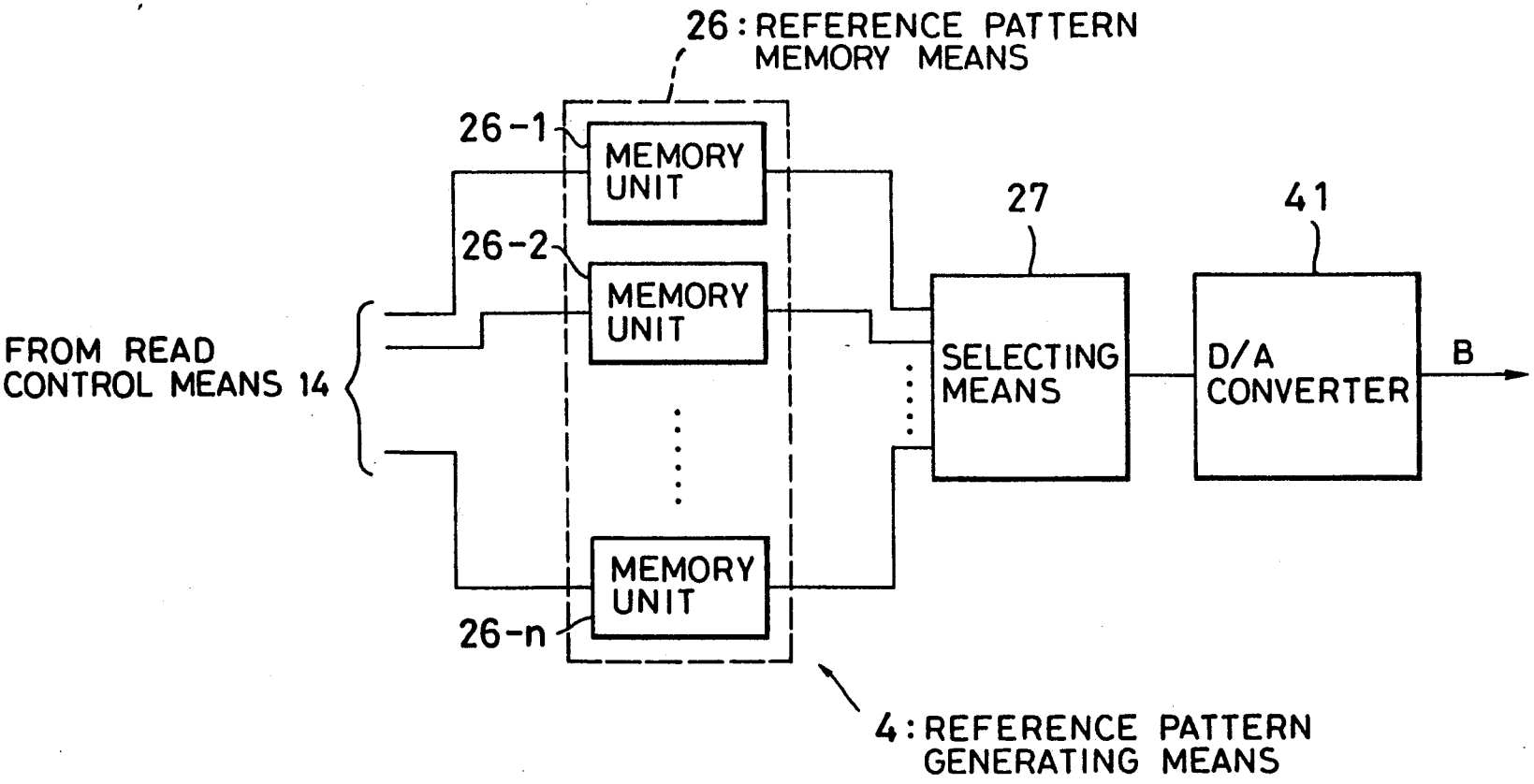
FIG. 6 is a block diagram showing an example of reference pattern generating means 4 in FIG. 5.

An example of the reference pattern generating means 2 is shown in FIG. 6. Like the allowable range pattern generating means 2 of FIG. 1, the reference pattern generating means 4 of the illustrated embodiment is responsive to the class data from the classifying means 13 and the scan line data from the read control means 24. The reference pattern generating means 4 outputs a reference pattern for the particular scan line of the particular bill.

The reference pattern generating means 4 comprises a memory means 26, a selecting means 27 and a digital-to-analog (D/A) converter 41.

The read control means 24 controls the timing of the operation of the detector 11, the memory means 12, the reference pattern memory means 26, the threshold value memory means 36, the subtractor 42 and the comparator 45. Specifically, the read control means 24 supplies the reference pattern memory means 26 with the scan line data indicating the scan line of the detected pattern data which is being supplied from the detector 11 via the amplifier 32 to the subtractor 42.

The reference pattern memory means 26 stores comprises memory means 26-1 to 26-*n* reference pattern data representing the reference patterns for the respective classes and the respective scan lines. More specifically, the reference pattern memory means 26 comprises memory units 26-1 to 26-*n* which are provided for the respective classes, and each of the memory units 26-1 to 26-*n* stores the reference pattern data representing the reference patterns for all the scan lines on the bill of the class for which it is provided.

The reference pattern for each scan line of each class is in the form of a function of a distance t from a reference point on the bill along the scan line, which the detected pattern is expected to resemble or follow if the bill is authentic and clean, and printing on it is with the average darkness, i.e., in an ideal state.

By supplying the scan line data, as address information, to all the memory units 26-1 to 26-*n*, the read control means 24 addresses the reference pattern data for the same scan lines of the different classes, so that the memory units 26-1 to 26-*n* are ready to produce the reference pattern data when accessed for reading.

It is convenient that the reference pattern data of the scan lines scanned by identical detecting elements be stored in corresponding memory locations in the memory units 26-1 to 26-*n* which are addressed by identical address information from the read control means 24.

On the basis of the class data, the reference pattern selecting means 27 selects the memory unit 26-*i* (one of the memory units 26-1 to 26-*n*) which stores the reference pattern data for the particular class. The reference pattern data of the selected memory unit 26-*i* and of the scan line designated by the read control line 24 is in the form of a series digital signals corresponding to one scan line, is output to the digital-to-analog converter 41. The digital-to-analog converter 41 converts the series of digital signals to a corresponding analog signal B representing a reference pattern.

The analog signal B representing a reference pattern is supplied to the subtractor 42, in synchronism with the supply of a detection signal A representing the detected pattern from the detector 11 via the amplifier 32.

Figure 7A:
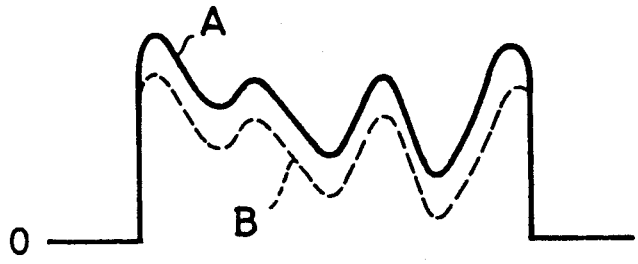
FIG. 7A to FIG. 7E and FIG. 8A to FIG. 8E are waveform diagrams for explaining the operation of the bill examination device of FIG. 5.
Figure 7B:
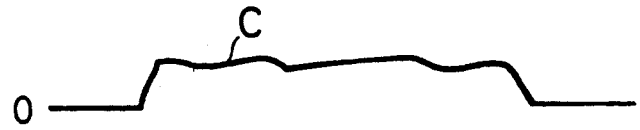

The subtractor 42 determines the difference between the detected pattern as represented by the amplified detection signal A and the reference pattern as represented by the analog signal B to produce a signal representing a reference pattern. An example of the detected pattern A and an example of the reference pattern B are shown in FIG. 7A, and an example of the difference pattern C is shown in FIG. 7B.

Figure 7C:
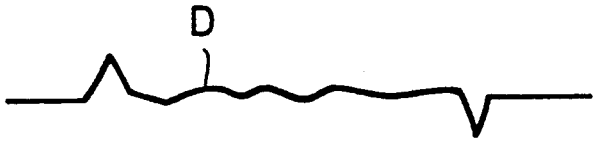

The filter 43 receives the difference pattern C and removes the direct-current component (as well as low-frequency components in the range of frequencies close to zero) of the difference pattern C. An example of the output of the filter 43, filtered difference pattern, D is shown in FIG. 7C.

An evaluating means 5 receives the filtered difference pattern D and makes authenticity judgement on the basis of the filtered difference pattern D.

The evaluating means 5 of this embodiment comprises an absolute value circuit 44, a threshold value generating means 6, a comparator 45 and a judging means 46.

Figure 7D:
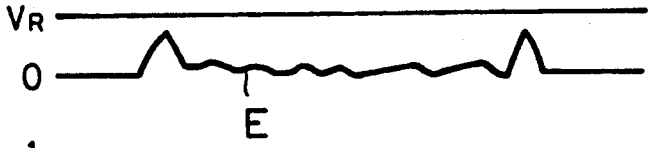
Figure 7E:
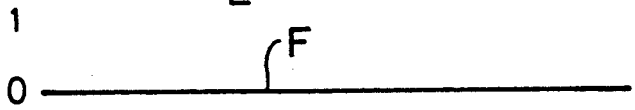
Figure 8A:
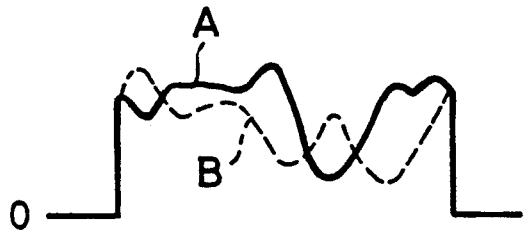
Figure 8B:
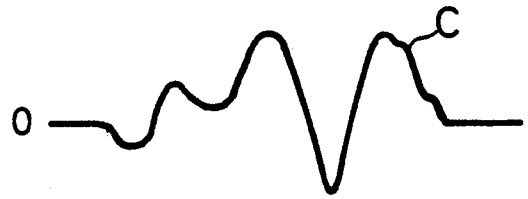
Figure 8C:
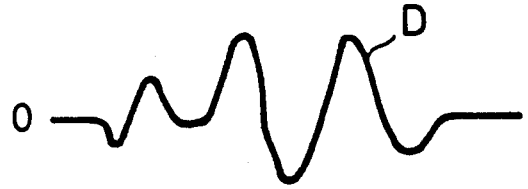
Figure 8D:
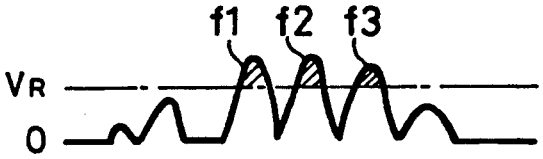
Figure 8E:
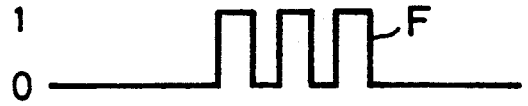

The absolute value circuit 44 receives the filtered difference pattern D and determines and outputs the absolute value E of the filtered difference pattern D. An example of the output E of the absolute value circuit 44 is shown in FIG. 7D.

The threshold value generating means 6 is responsive to the class data from the classifying means 13 and the scan line data from the read control means 24, for generating a voltage signal representing a threshold value $V_R$ for the particular scan line of the particular class. The threshold value $V_R$ is constant throughout the period for which the output of the absolute value circuit 44 for one scan line is produced.

The threshold value generating means 6 may have a configuration similar to that of the reference pattern generating means 4. However, as the threshold value $V_R$ is constant for one scan line, the amount of data which needs to be stored in the threshold value generating means 4 is much smaller. Instead of using a combination of a memory means, a selecting means and a digital-to-analog converter, a voltage divider with output taps for the required voltages may be used. Where the threshold voltage $V_R$ is a identical for all the classes and for all the scan lines, the threshold voltage generating means 4 may comprise a voltage divider with a single output tap.

The threshold value $V_R$ is so predetermined as not be exceeded by the output of the absolute value circuit 44 if the bill is authentic.

By supplying the scan line data, as address information, to all the memory units 36-1 to 36-*n*, the read control means 24 addresses the threshold values for the same scan lines of the different classes, so that the memory units 36-1 to 36-*n* are ready to produce the threshold value when accessed for reading.

It is convenient that the threshold value of the scan lines scanned by identical detecting elements be stored in corresponding memory locations in the memory units 36-1 to 36-*n* which are addressed by identical address information from the read control means 24.

On the basis of the class data, the reference pattern selecting means 37 selects the memory unit 36-*i* (one of the memory units 36-1 to 36-*n*) which stores the threshold value for the particular class. The threshold value of the selected memory unit 36-*i* and of the scan line designated by the read control line 24 is in the form of an analog voltage signal $V_R$, and is output to the comparator 45.

The comparator 45 compares the output E of the absolute value circuit 44 and the reference voltage $V_R$.

The comparator 45 compares the magnitudes of the signal E and the reference voltage $V_R$, and outputs a binary signal of "1" if the signal E is greater than the reference voltage $V_R$, and of "0" if the signal e is smaller than the reference voltage $V_R$, and outputs the binary signal F indicating the result of comparison.

In the case shown in FIG. 7A to FIG. 7E, output of the comparator 45 is kept at "0" affirming the authenticity of the bill. In the case shown in FIG. 8A to FIG. 8E respectively corresponding to FIG. 7A to FIG. 7E, the output E of the absolute value circuit 44 exceed the reference voltage $V_R$ at the hatched areas f1, f2 and f3, and the output F of the comparator 45 assumes the level "1" at the corresponding three time points, negating the authenticity of the bill.

The judging means 46 makes judgement as to whether or not the bill in question is an authentic one or a forged one on the basis of the results of the comparison from the comparator 45 in connection with all the scan lines of the bill.

The judging means 46 makes a final or synthetic judgement on whether the bill is authentic or forged, on the basis of the comparison result signals for a plurality of scan lines, e.g., all the scan liens on the bill, and outputs the authenticity test result signal to the host device 22. For instance, when the result of comparison negates the authenticity in connection with a predetermined number or more the scan lines, the result of the synthetic judgement may be recognition of the bill as a forged one. The above-mentioned predetermined number may be one. Naturally, if the bill is not recognized as a forged one, the bill is found as an authentic one. The synthetic result of the synthetic judgement is sent, as the authenticity test result G, to the host device 22.

Figure 5:
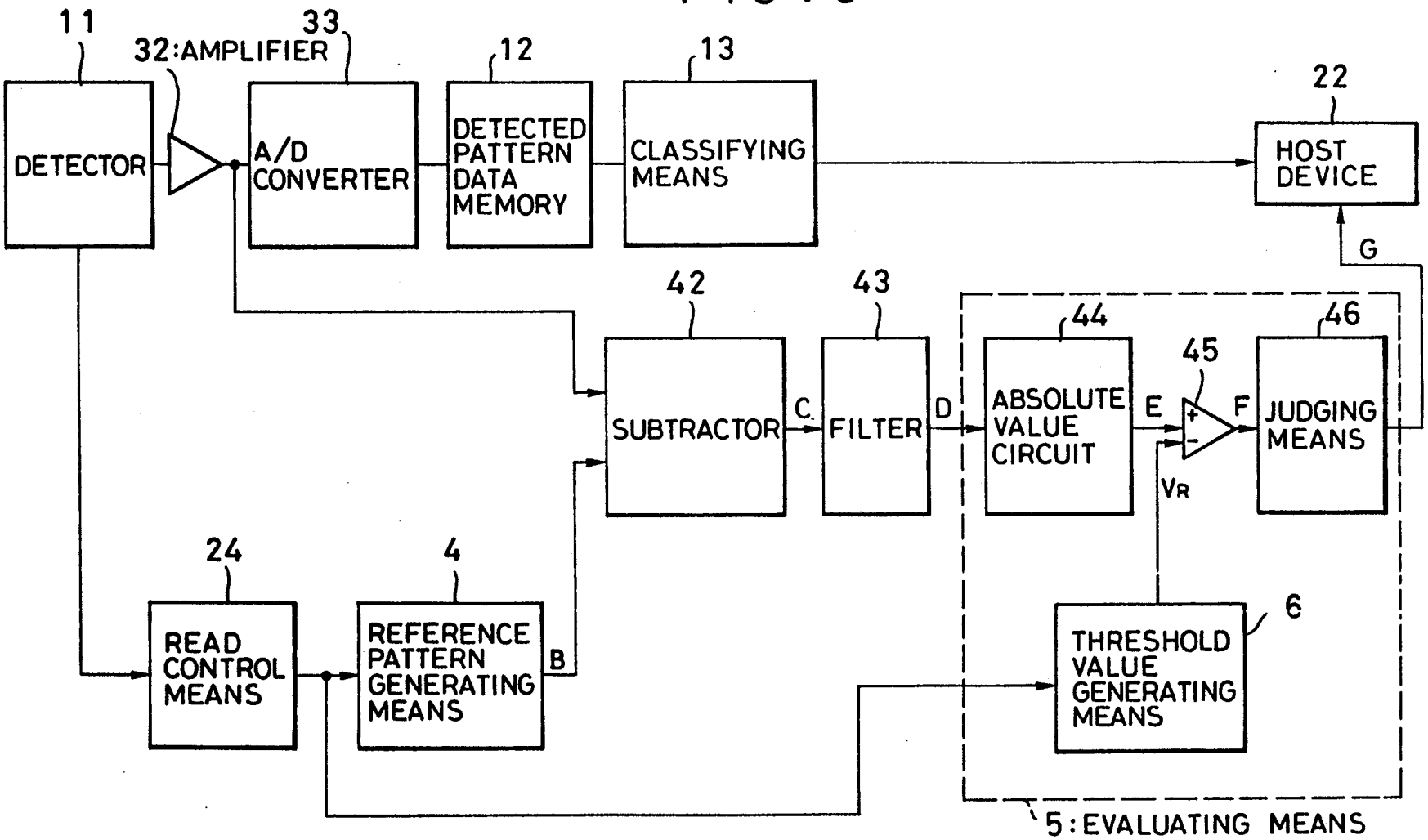
FIG. 5 is a block diagram showing a second embodiment of the bill examination device according to the invention.
Figure 9:
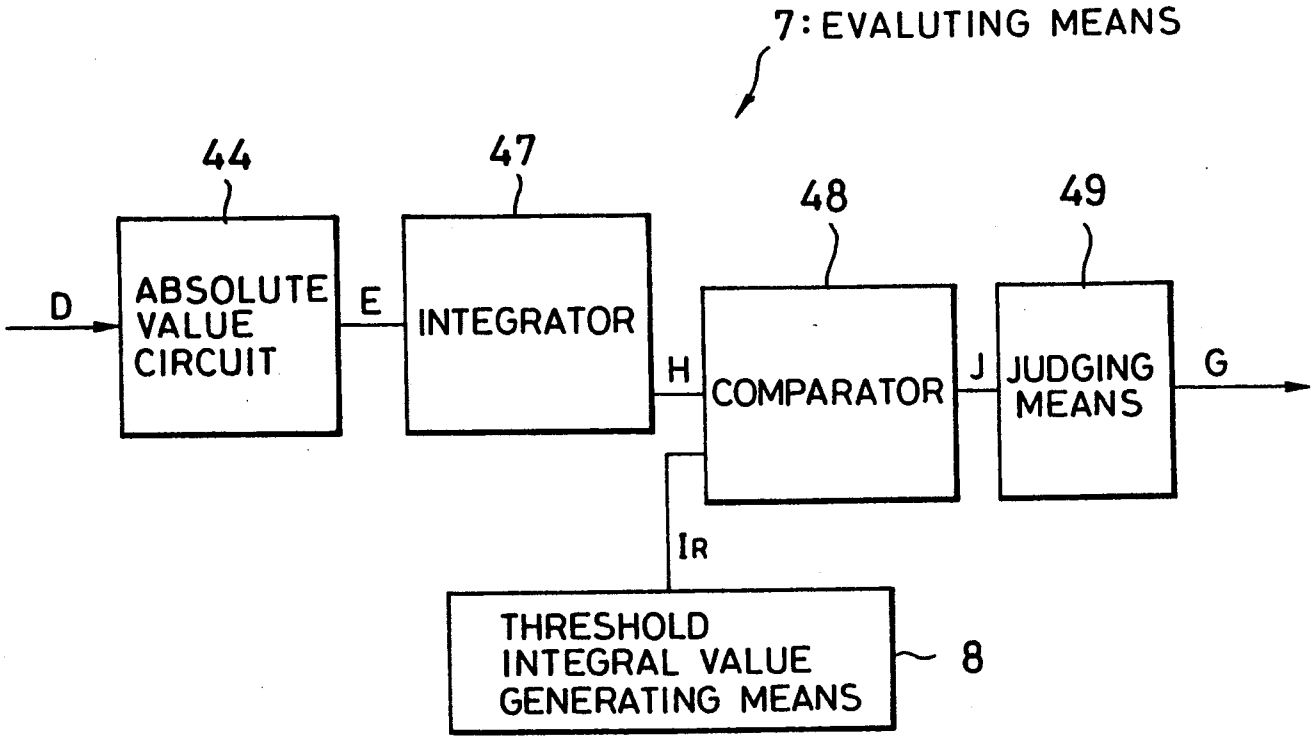
FIG. 9 is a block diagram showing another example of evaluating means 5 which can be used in place of the evaluating means 6 in FIG. 5.

FIG. 9 shows a modification of an evaluating means 7 which may be used in place of the evaluating means 5 of FIG. 5. In the modification of FIG. 9, the output E of the absolute value circuit 44 is input to and integrated at an integrator 47, and the output H of the integrator 47 is compared at a comparator 48 with a threshold integral value $I_R$ from a threshold integral value generating means 8. The threshold integral value generating means 8 may be similar to the threshold value generating means except that it outputs the threshold values $I_R$ suitable for comparison with the output H of the integrator 47, rather than the output of the absolute value circuit 44 in FIG. 5. The comparator 48 is similar to the comparator 45 and compares the output H of the integrator 47 with the threshold integral value $I_R$ and produces the result of comparison, J. The judging means 49 tests the authenticity of the bill on the basis of the output J of the comparator 48, and produces the result of the authenticity test, G, which is sent to the host device. The operation of the comparator 48 and the judging means 49 is similar to that of the comparator 45 and the judging means 46.

In a further modification, the authenticity test made on the basis of the output of the absolute value circuit 44 as in the arrangement of FIG. 5 and the authenticity test on the basis of the output of the integrator 47 as in the arrangement of FIG. 9 may both be performed, and the results of the tests may be combined or synthesized to make a final or synthetic test on the authenticity.

As will be apparent from the above description, the filter 43 removes the direct-current component (as well as the low-frequency components in the range of frequencies close to zero) of the difference between the detection signal and the reference pattern. As a result, the effect of the differences and variations in the sensitivities and offsets of the detecting elements and other circuit components, and the differences in the darkness of printing on the bill or smudge on the bill is reduced, and the reliability of the authenticity test is improved.

In the embodiments described, the bill is classified on the basis of the physical pattern on bills. For classifying the bill, other tests, such as a test in accordance with the outer shape of the bill may be used in place or in combination.

In the embodiments described, the class of the bill is identified. Where the direction of bill as it passes the detecting elements and the side with which the bill faces the detecting elements can be made invariable, for instance by use of a mechanism for turning the bill for alignment, the only classification required is identification of the denomination. Under such a circumstance, the classifying means 13 may be replaced by or made to serve only as a denomination identification means, and the allowable range pattern memory means 16, the reference pattern memory means 26, the threshold value memory means 36 or 56 needs only to store the respective patterns or values for the respective denominations, and the capacity of the memory means can therefore be reduced.

What is claimed is:

1. A bill examination device comprising:

a detecting means for detecting a physical pattern of a bill;

a differentiating means for differentiating the physical pattern to produce a differential pattern;

an allowable range pattern generating means for outputting an allowable range pattern;

a comparing means for comparing the differential pattern with the allowable range pattern, and outputting the result of comparison; and a judgement means responsive to the result of comparison from the comparing means for making judgement on the authenticity of the bill;

wherein said detecting means comprises a plurality of detecting elements positioned at different lateral positions with respect to the direction in which the bill is moved relative to the detecting means, and said detecting means detects a plurality of physical patterns at different lateral positions along a plurality of scan lines.

2. The device of claim 1, wherein said allowable range pattern output from said allowable range pattern generating means comprises an upper-limit reference pattern and a lower-limit reference pattern, which are functions of a distance from a reference point along the scan line on the bill, and between which the differential pattern is expected to lie if the bill is authentic.

3. The device of claim 1, wherein the comparator produces an output which does not affirm the authenticity of the bill if the differential pattern is not entirely between the upper-limit and the lower-limit reference patterns.

4. The device of claim 1, further comprising:

a classification means responsive to the physical pattern detected by said detecting means to identify the class of the bill;

wherein said allowable range pattern generating means stores allowable range patterns for respective classes of bills, and selectively outputs, responsive to the result of the classification, the allowable range pattern for the identified class of the bill.

5. The device of claim 1, further comprising:

a read control means producing a scan line signal indicative of the scan line of which the physical pattern is supplied from detecting means to the comparing means;

wherein said allowable range pattern generating means stores allowable patterns for the respective scan lines of the bill, and selectively outputs, responsive to the scan line signal, the allowable range pattern for the scan line indicated by the scan line signal;

said comparing means compares the physical patterns along the respective scan lines with the respective allowable range patterns and outputs the results of comparison for the respective scan lines; and said judgement means makes the judgement on the basis of the results of comparison in connection with the plurality of physical patterns.

6. The device of claim 5, wherein said judgement means finds the bill as a forged one when the comparator produces an output which does not affirm the authenticity of the bill, in connection with a predetermined number or more of scan lines.

7. The device of claim 6, wherein said predetermined number is one.

8. The device of claim 1, wherein said detecting means is disposed by a bill conveyance path along which the bill is moved for conveyance, said scanning is conducted by moving the bill along the conveyance path, past the detecting means.

9. The device of claim 1, wherein at least one of said plurality of detecting elements comprising a photo-detecting element responsive to light reflected at the surface of the bill or light transmitted through the bill, and said physical pattern is an optical pattern obtained by scanning the bill with the photo-detecting element.

10. The device of claim 1, wherein at least one of said plurality of detecting elements comprises a magnetic detecting element responsive to a magnetic material on the bill, and said physical pattern is a magnetic pattern obtained by scanning the bill with the magnetic detecting element.

11. A bill examination device, comprising:

a detecting means for detecting a physical pattern of a bill;

a reference pattern generating means for outputting a reference pattern;

a subtracting means for determining the difference between the physical pattern and said reference pattern to produce a difference pattern;

a filter means for removing the direct-current component from the difference pattern to produce a filtered difference pattern; and an evaluating means for evaluating the filtered difference pattern to test the authenticity of the bill.

12. The device of claim 11, wherein said evaluating means comprises:

an absolute value circuit receiving the filtered absolute value and outputting an absolute value of the filtered difference pattern;

a comparing means for comparing the filtered difference pattern with a predetermined threshold value, and outputting the result of comparison; and a judging means for testing the authenticity of the bill on the basis of the output of the comparing means.

13. The device of claim 12, wherein the comparing means produces an output which does not affirm the authenticity of the bill if the output of the comparing means exceeds the threshold value.

14. The device of claim 11, wherein said evaluating means comprises:

an absolute value circuit receiving the filtered absolute value and outputting an absolute value of the filtered difference pattern;

an integrating means for integrating the output of the absolute value circuit;

a comparing means for comparing the output of the integrating means with a predetermined threshold value, and outputting the result of comparison; and a judging means for testing the authenticity of the bill on the basis of the output of the comparing means.

15. The device of claim 14, wherein the comparing means produces an output which does not affirm the authenticity of the bill if the output of the comparing means exceeds the threshold value.

16. The device of claim 11, wherein said reference pattern output from said reference pattern generating means is a function of a distance from a reference point along the scan line on the bill, and which is followed by the physical pattern if the bill is authentic and ideal.

17. The device of claim 11, further comprising:

a classification means responsive to the physical pattern detected by said detecting means to identify the class of the bill;

wherein said reference pattern generating means stores reference patterns for respective classes of bills, and selectively outputs, responsive to the result of the classification, the reference pattern for the identified class of the bill.

18. The device of claim 17, further comprising a threshold value generating means for storing threshold values for respective classes of bills, and selectively outputs, responsive to the result of classification, the threshold value for the identified class of the bill.

19. The device of claim 11, wherein said reference pattern generating means comprises a reference pattern memory means for storing said reference pattern in the form of digital signals, and outputting said digital signals, and a digital-to-analog converter for converting the digital signals from the reference pattern memory means into an analog signal representing a reference pattern.

20. The device of claim 11, wherein said detecting means comprises a detecting element and said physical pattern is obtained by scanning the bill along a scan line with said detecting element.

21. The device of claim 20, wherein said detecting means comprises a plurality of detecting elements positioned at different lateral positions with respect to the direction in which the bill is moved relative to the detecting means, and said detecting means detects a plurality of physical patterns at different lateral positions along a plurality of scan lines.

22. The device of claim 21, further comprising:

a read control means producing a scan line signal indicative of the scan line of which the physical pattern is supplied from detecting means to the subtracting means;

wherein said reference pattern generating means stores reference patterns for the respective scan lines of the bill, and selectively outputs, responsive to the scan line signal, the reference pattern for the scan line indicated by the scan line signal;

said subtracting means compares the physical patterns along the respective scan lines with the respective reference patterns and outputs the difference patterns for the respective scan lines;

said filter means receives said difference patterns from the subtracting means, and outputs the filtered difference patterns for the respective scan lines; and said evaluating means makes the judgement on the basis of the results of comparison in connection with the plurality of physical patterns.

23. The device of claim 22, wherein said judgement means finds the bill as a forged one when the comparing means produces an output which does not affirm the authenticity of the bill, in connection with a predetermined number or more of scan lines.

24. The device of claim 23, wherein said predetermined number is one.

25. The device of claim 20, wherein said detecting element is disposed by a bill conveyance path along which the bill is moved for conveyance, said scanning is conducted by moving the bill along the conveyance path, past the detecting element.

26. The device of claim 20, wherein said detecting element comprises an photo-detecting element responsive to light reflected at the surface of the bill or transmitted through the bill, and said physical pattern is an optical pattern obtained by scanning the bill with the photo-detecting element.

27. The device of claim 20, wherein said detecting element comprises a magnetic detecting element responsive to a magnetic material, and said physical pattern is a magnetic pattern obtained by scanning the bill with the magnetic detecting element.

* * * * *